United States Patent [19]

Schwartzberg et al.

[11] Patent Number: 4,475,323

[45] Date of Patent: Oct. 9, 1984

[54] BOX TRUSS HOOP

[75] Inventors: Fred R. Schwartzberg, Denver; William H. Tobey, Littleton, both of Colo.

[73] Assignee: Martin Marietta Corporation, Bethesda, Md.

[21] Appl. No.: 373,571

[22] Filed: Apr. 30, 1982

[51] Int. Cl.[3] ..... E04H 12/34

[52] U.S. Cl. ..... 52/111; 52/646; 52/645; 343/881; 343/915

[58] Field of Search ..... 52/108, 109, 111, 632, 52/645, 646, 80, 81; 343/748, 866, 871, 880, 915

[56] References Cited

U.S. PATENT DOCUMENTS

| | | | |
|---|---|---|---|
| 2,670,818 | 3/1954 | Hacker | 52/80 |
| 2,982,379 | 5/1961 | Fisher | 52/645 |
| 3,174,397 | 3/1965 | Sanborn | 52/109 |
| 3,408,029 | 10/1968 | Vyvyan et al. | 248/351 |
| 3,486,279 | 12/1969 | Mauch | 52/108 |
| 3,496,687 | 2/1970 | Greensberg et al. | 52/109 |
| 3,564,789 | 2/1971 | Vyvyan et al. | 52/108 |
| 3,751,863 | 8/1973 | Lyons | 52/111 |
| 3,771,274 | 11/1973 | Vaughan | 52/646 |
| 3,913,105 | 10/1975 | Williamson et al. | 343/840 |
| 4,030,102 | 6/1977 | Kaplan et al. | 343/915 |

OTHER PUBLICATIONS

Aviation Week, vol. 111, No. 19, Nov. 5, 1979, p. 57.

Martin Marietta Report No. 78-52411-01, Dec. 1978, "Deployable Box Truss Space Structure", Copies Submitted to USAF in 1979, Further Distribution by USAF Undetermined.

*Primary Examiner*—James L. Ridgill, Jr.

*Attorney, Agent, or Firm*—Patrick M. Hogan; Phillip L. DeArment; Gay Chin

[57] ABSTRACT

A box truss hoop which is defined by circumferentially adjacent collapsible boxes. The hoop is expandable radially from a compact, folded configuration to a deployed hoop configuration. Each of the boxes includes collapsible inner and outer frames, connecting side members extending between the inner and outer frames and diagonal braces. When employed as an antenna, the box truss hoop includes a shaped reflective surface extending across the hoop and a feed located at the focus of the reflective surface.

26 Claims, 18 Drawing Figures

BOX TRUSS HOOP

BACKGROUND OF THE INVENTION

1. Field of the Invention

This invention relates to trusses and particularly to a new and improved box truss hoop which folds compactly yet which deploys to a large, stiff hoop structure for supporting components such as antenna reflective surfaces.

2. Description of the Prior Art

One type of antenna system employs a reflective surface stretched across a hoop structure. When such antenna systems are to be launched into space, they must be foldable so as to fit into launch vehicles having limited cargo capacity, and, once in space, the antenna system must deploy to a size sufficiently large to justify the cost of launching it.

The reflective surface of the antenna often has a parabolic or spherical shape to reflect radio waves to a receiving element, or feed, mounted ahead of the reflective surface at its focus. Since the reflective surface is flexible so that it can be folded with the hoop structure, it is important that the deployed hoop structure be of sufficient stiffness such that the shape of the reflective surface can be maintained. Additionally, it is desirable that the hoop structure have sufficient depth such that the shaped reflective surface and its shaping system can be substantially contained within the interior of the hoop structure, rather than requiring additional attachment points above or below the hoop.

The requirements for stiffness and depth, however, contrast with another requirement for space antenna systems that the hoop structure be foldable in order to fit into the launch vehicle.

Different configurations of deployable hoop structures have been developed, yet most are unable to fully meet the stiffness, depth and foldablility requirements. Where stiffness and depth are emphasized, the hoop is often bulky and heavy, making it difficult for the hoop to be compactly folded to fit into the launch vehicle. Alternatively, when the hoop is designed to fold compactly, it is often relatively flimsy and shallow, adversely affecting the performance of the antenna.

In view of the above-mentioned problems, it is therefore an object of the present invention to provide a hoop structure with sufficient stiffness to properly support components attached to it.

Another object of the present invention is to provide a hoop structure with enough depth such that a parabolic or spherical shaped reflective surface and its shaping system can be substantially contained within the interior of the hoop.

Still another object of the present invention is to provide a hoop structure which folds compactly yet which deploys to a relatively large size.

SUMMARY OF THE INVENTION

The present invention, in accordance with one embodiment thereof, comprises a box truss hoop. The hoop comprises a plurality of circumferentially adjacent collapsible boxes arranged whereby the hoop is expandable radially from a compact, folded configuration to a deployed hoop configuration. Each of the boxes comprises collapsible inner and outer frames disposed parallel and radially apart and a plurality of connecting side members extending between the inner and outer frames.

In a particular embodiment of the invention, the box truss hoop includes a generally curved reflective surface extending across the hoop and a feed disposed at the focus of the reflective surface. Feed support means extend between the feed and the box truss hoop.

BRIEF DESCRIPTION OF THE DRAWING

This invention will be better understood from the following description taken in conjunction with the accompanying drawing, wherein.

DESCRIPTION OF THE PREFERRED EMBODIMENT

Figure 1:
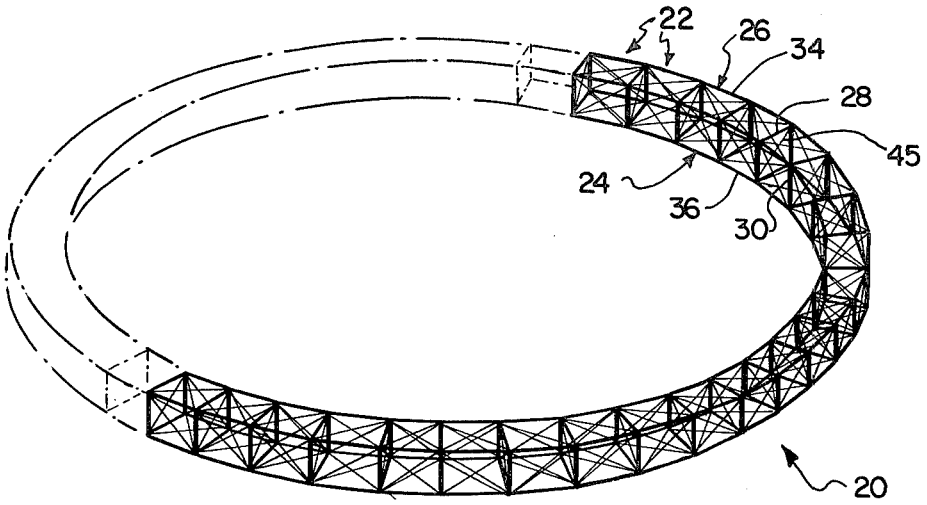
FIG. 1 is a perspective view of the box truss hoop of the present invention.

Turning now to a consideration of the drawing, and in particular to FIG. 1, there is shown the box truss hoop 20 of the present invention in its deployed, or unfolded, configuration. The box truss hoop 20 comprises a plurality of circumferentially adjacent collapsible boxes 22 which are arranged such that the box truss hoop is expandable radially from a compact, folded configuration to the deployed hoop configuration of FIG. 1.

Figure 2:
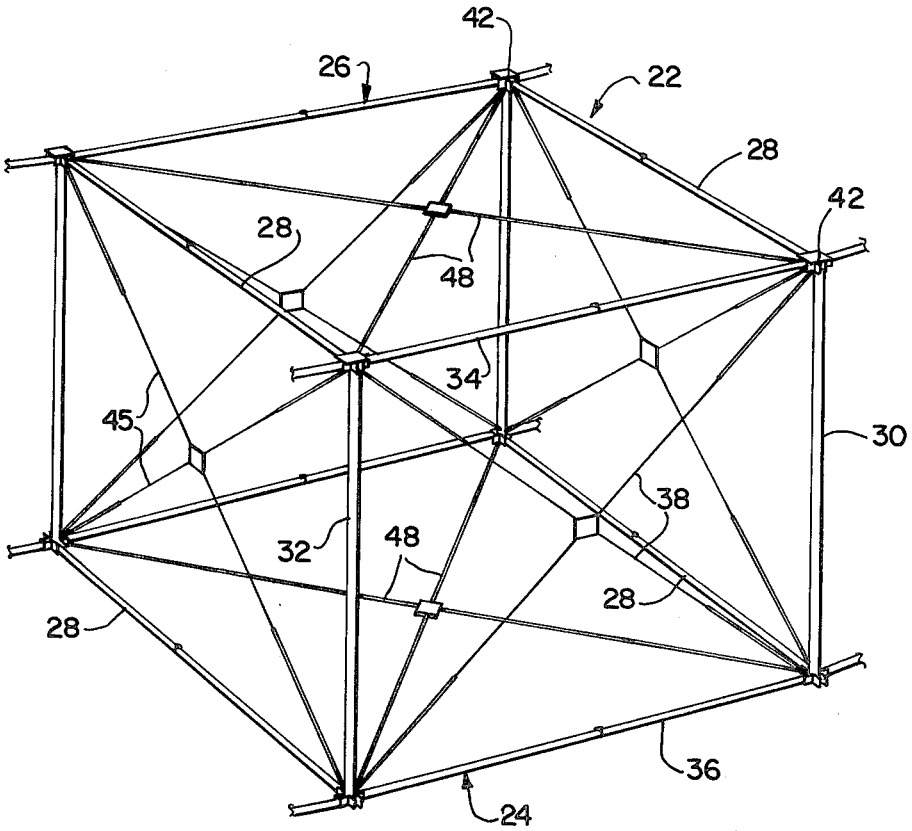
FIG. 2 is a perspective view of one of the boxes comprising the box truss hoop.

Turning now to FIG. 2, there is shown one of the boxes 22 comprising the box truss hoop 20 in a deployed configuration. Each of the boxes 22 is defined by collapsible frames arranged such that the box will fold compactly. More specifically, each box 22 comprises a collapsible inner frame 24 and a collapsible outer frame 26 disposed parallel and radially apart. The terms "inner" and "outer" are intended to indicate radially inner and radially outer with respect to relative radial positions from the center of the box truss hoop 20. Each box 22 also comprises a plurality of connecting side members 28 extending between the inner and outer frames 24 and 26.

Figure 3:
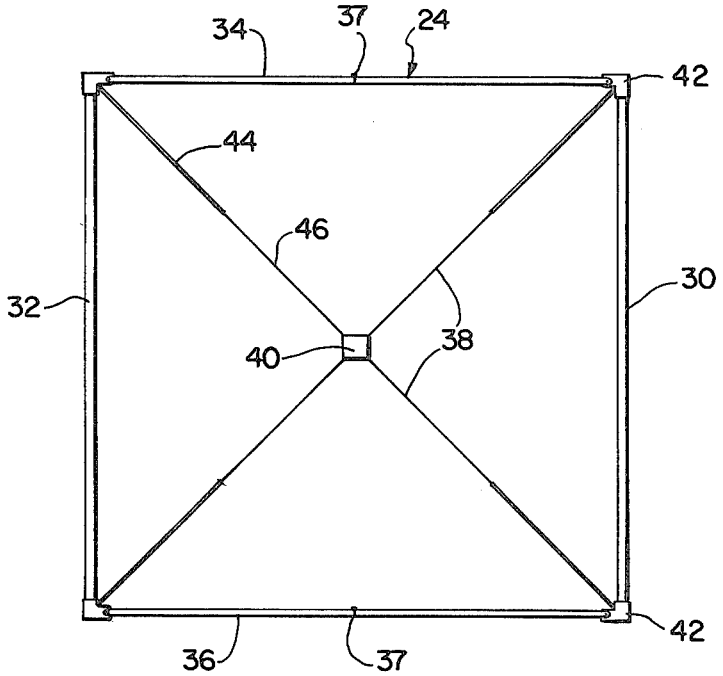
FIG. 3 is a front view of one of the frames of the box in a deployed configuration.

FIG. 3 shows the inner frame 24 in its deployed configuration. The outer frame 26 is substantially identical to the inner frame 24 and thus the following description will be applicable to both. The inner frame 24 comprises two rigid members 30 and 32 and two folding members 34 and 36 extending between each pair of corresponding ends of the rigid members 30 and 32. The folding members are hinged for folding at the centers thereof at hinges 37.

The inner frame 24 also preferably includes axially expandable diagonal braces 38 extending between each pair of diagonally opposite ends of the rigid members 30 and 32. The diagonal braces maintain the structural rigidity of the frame. FIG. 3 shows the diagonal braces as comprising two pairs of axially aligned diagonal members each having an inner end connected to a central bracket 40 and an outer end connected to a corner fitting 42 at the end of one of the rigid members 30 or 32. An example of an arrangement which permits the diagonal braces 38 to be axially expandable is a telescopic configuration. Each diagonal member can comprise an outer segment 44 and an inner segment 46 which is slidable within the outer segment 44 for thus varying the length of the diagonal member.

Figure 4:
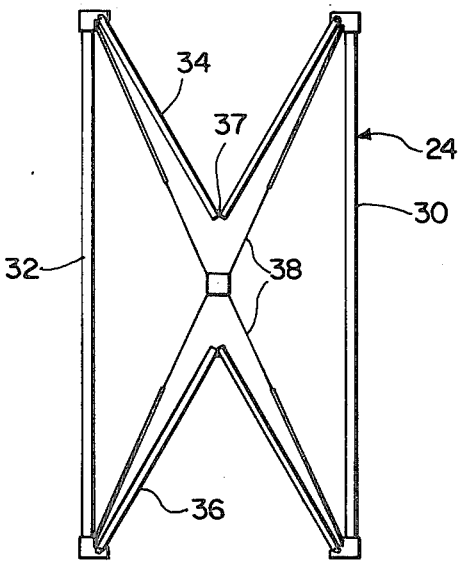
FIG. 4 is a view of the frame in a partially folded configuration.

The inner frame 24, as well as the outer frame 26, is collapsible from the deployed configuration of FIG. 3 to the folded configuration of FIG. 5 as follows. The folding members 34 and 36 are folded toward the interior of the inner frame as is shown in FIG. 4. As the folding members fold, the rigid members 30 and 32 are pulled closer to each other. Since diagonal braces 38 are axially expandable, they reduce in length during folding.

Figure 5:
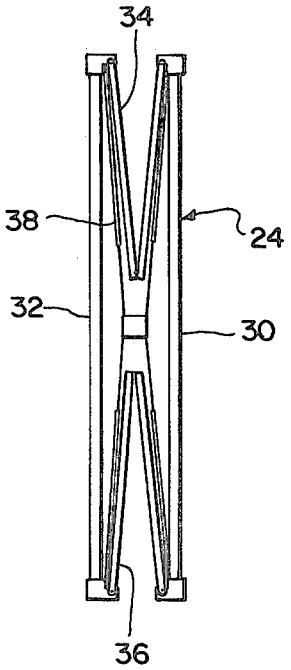
FIG. 5 is a view of the frame in a folded configuration.

FIG. 5 shows the inner frame 24 in a folded configuration. The folding members 34 and 36 are folded such that the halves thereof substantially abut, the diagonal braces 38 are shortened to their minimum lengths, and the rigid members 30 and 32 are pulled closely adjacent each other.

Deployment of the inner frame 24 is accomplished in the reverse order of that described above. In order to assist in deployment, each of the hinges 37 can include biasing means, such as a spring 47 shown in FIG. 6 adjacent the hinged center of the folding member, to urge the folding member to a deployed position. The hinge 37 can also include locking means, such as an over center latch 49 shown in FIG. 6 in dashed lines, to help maintain its folding member 34 or 36 in the deployed position.

Returning to FIG. 2, it can be seen that there are preferably four connecting side members 28 extending generally radially between the inner and the outer frames 24 and 26, each of the connecting side members being foldable at the center thereof. Similar to the folding members 34 and 36, each connecting side member 28 can also include biasing means, such as a spring adjacent the hinged center thereof, for urging the connecting side member into a deployed position. The connecting side member 28 can also include locking means such as an over center latch to help maintain it in a deployed position. Axially expandible diagonal braces 45 preferably extend in the side surface planes of the box 22, that is, in the planes containing connecting side members 28 and rigid members 30 or 32, between each pair of diagonally opposite ends of the rigid members 30 or 32. The diagonal braces 45 have the same function and configuration as the diagonal braces 38. Thus, as can be seen in FIG. 2, each of the frames defined in the side surface planes of the box 22 by two connecting side members 28, two rigid members 30 or 32, and diagonal braces 45 is substantially the same as the inner and outer frames 24 and 26.

A corner fitting 42 is included at each of the eight corners of the box 22. Each corner fitting 42 is mounted at an end of a rigid member 30 or 32 and provides attachment points for the folding members and diagonal braces.

In order to provide additional structural rigidity and stiffness to the box 22, there are preferably included axially expandable diagonal braces 48 disposed in the upper and lower surface planes of the box, that is, those surface planes other than those that include diagonal braces 38 or 45. The diagonal braces 48 extend in the upper and lower surface planes between each pair of diagonally opposite corners of the inner and outer frames 24 and 26.

As will be discussed more fully later, when the box 22 is in a folded configuration, the four corner fittings 42 in the upper surface plane are disposed closely adjacent each other and the four corner fittings 42 in the lower surface plane are likewise disposed closely adjacent each other. Thus, each of the axially expandable diagonal braces 48 extending between the corner fittings 42 in those planes must be capable of reducing in length to a very short dimension. Consequently, rather than a telescopic configuration, a tape or cord coilable onto a spool might be a more appropriate diagonal brace arrangement for providing the required degree of axial expandability.

Each of the boxes 22 is thus a self-contained structure possessing a high degree of stiffness. Likewise, the box truss hoop 20 which comprises a plurality of the boxes 22 is a structure providing sufficient stiffness so as to properly support components attached to it.

The box 22 is collapsed from the deployed configuration of FIG. 2 to a folded configuration by simultaneously or sequentially collapsing the inner and outer frames 24 and 26, in the manner described above, and by folding the connecting side members 28. The connecting side members 28 fold in the same manner as do the folding members 34 and 36 of the inner and outer frames 24 and 26. As the box 22 is collapsed, the length of the diagonal braces 48 in the upper and lower surface planes of the box are reduced in length, such as by coiling them. The box 22 is deployed from a folded configuration to a deployed configuration in the reverse manner as that described above.

Any suitable actuation means can be employed to effect deployment or collapsing of each of the boxes 22 of the box truss hoop 20. For example, motor driven hinges (not shown) could be employed at the hinged centers of the folding members 34 and 36 and of the connecting side members 28. Such motor driven hinges could not only deploy the boxes but also could collapse them.

Figure 6:
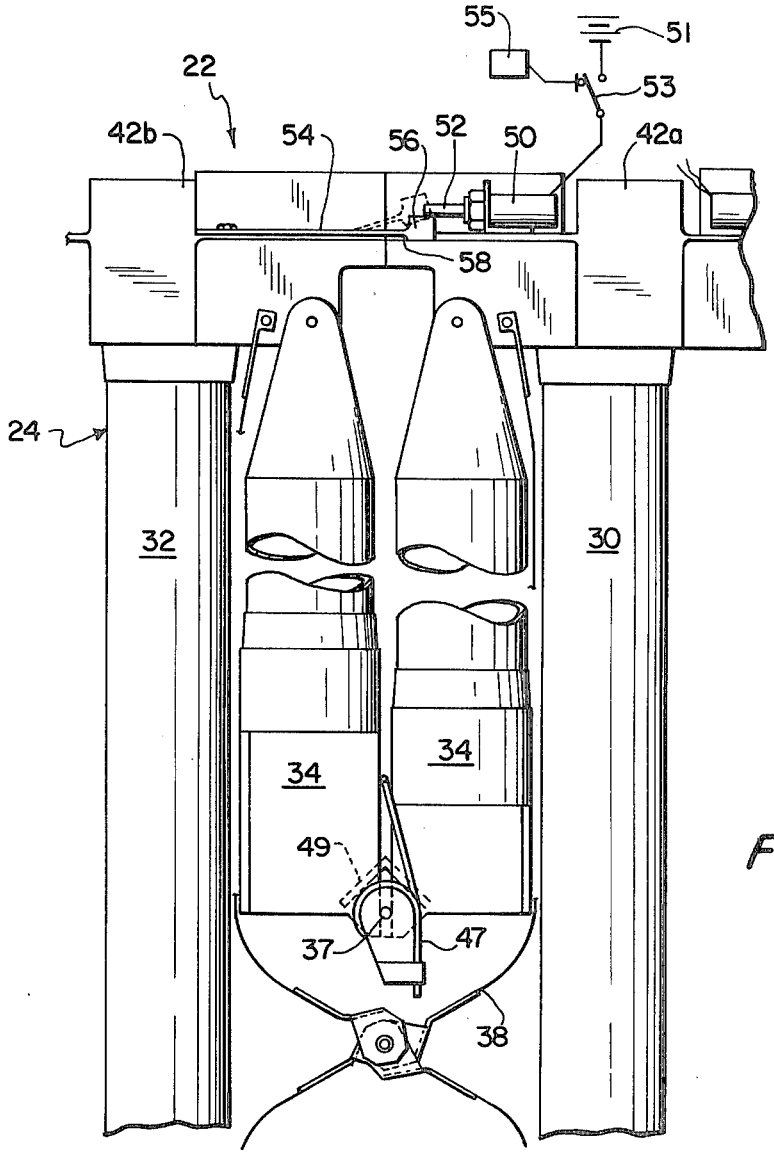
FIG. 6 is a side view partially broken of a portion of one of the frames of the box showing a solenoid operated latch arrangement.

On the other hand, when a one-time, permanent deployment is anticipated, such as when the box truss hoop 20 is launched into orbit in space, less costly actuation means can be employed. Each of the boxes 22 could be initially collapsed into the folded configuration manually. Deployment-only actuation means can then be used to deploy the boxes. For example, FIG. 6 shows a portion of the inner frame 24 of the box 22 being maintained in a folded configuration by a solenoid operated latch arrangement. A solenoid 50 operates a plunger 52 and is mounted on one of the corner fittings **42*a* adjacent one of the rigid members 30. A resilient latch 54 is mounted on an adjacent corner fitting 43*b* adjacent the other rigid member 32. The latch 54 includes a flange 56 which extends to the corner fitting 42*a* and which is shaped and sized to be received in a depression 58 in the corner fitting 42*a*. When the inner frame 24 is in a folded configuration, the plunger 52 is positioned to abut against a surface of the flange 56 to maintain it in the depression 58, thus holding the corner fittings 42*a* and 42*b* together. The folding member 34 is thus maintained in a folded position. When deployment of the inner frame 24 is desired, electrical power is supplied to the solenoid 50 from an electrical power source, such as a battery 51, through a switch 53** operated by central control means 55, which also controls switches for other solenoid operated latch arrangements in the box truss hoop 20. The plunger 52 is retracted by the solenoid 50 to the position shown by the dashed lines such that it no longer abuts against the flange 56. Because the latch 54 is resilient, it moves the flange 56 out of the depression 58 to the position shown by the dashed lines. The corner fittings 42*a* and 42*b* are no longer locked together and the force of the spring 47 urges the halves of the folding member 34 to pivot away from each other about the hinge 37. As the folding member 34 deploys, it forces apart the corner fittings 42*a* and 42*b* as well as the rigid members 30 and 32. A separate solenoid operated latch arrangement can be employed for each folding member 34 and 36 and for each connecting side member 28 of the box 22. Thus the order in which those members deploy can be controlled by the central control means 55 which sequentially powers the proper solenoids 50.

Returning to FIG. 1, in order to reduce weight and cost, it is preferable that for each pair of adjacent boxes 22, a rigid member 30 of the inner frame, a rigid member 30 of the outer frame, two connecting side members 28, and the diagonal braces 45 lying in the plane of the two connecting side members are common to and thereby comprise portions of both of the adjacent boxes 22.

The shape of the box truss hoop 20 can be established by varying the dimensions of the components of each box. As is seen in FIG. 1, in order to provide a curved shape to the box truss hoop 20, it is preferable that in at least some of the boxes 22, the folding members 34 and 36 of the inner frame 24 are shorter than the folding members 34 and 36 of the outer frame 26.

Turning now to FIGS. 7 through 12, there is shown a deployment sequence for a first embodiment of the box truss hoop 20.

Figure 7:
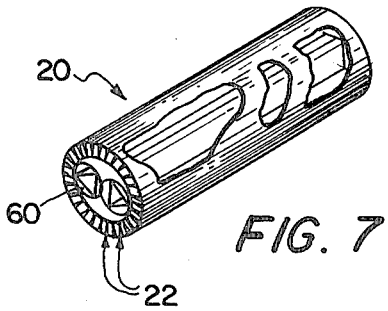
FIGS. 7 through 12 show the deployment sequence of a first embodiment of the present invention.

FIG. 7 shows the box truss hoop 20 in a compact, folded configuration. Each of the boxes 22 has been collapsed such that the folded hoop appears to have a cylindrical shape. In the interior of the folded box truss hoop can be seen a feed 60 likewise folded which, as will be more fully explained hereinafter, is included when the box truss hoop 20 supports an antenna reflective surface.

Figure 7A:
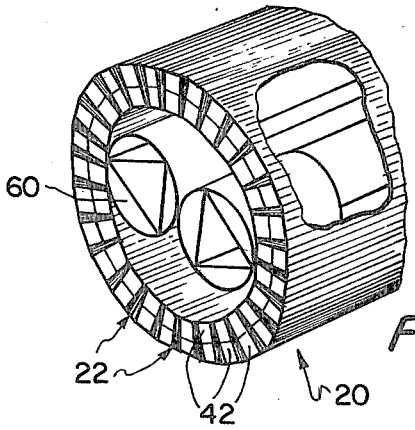
FIG. 7A is an enlarged view of a portion of the folded box truss hoop of FIG. 7.

FIG. 7*a* is an enlarged view of a portion of the folded box truss hoop 20 of FIG. 7. A plurality of corner fittings 42 can be seen disposed about the end of the box truss hoop. Each group of two radially inner and two radially outer corner fittings 42 defines the end of a folded box 22.

Figure 8:
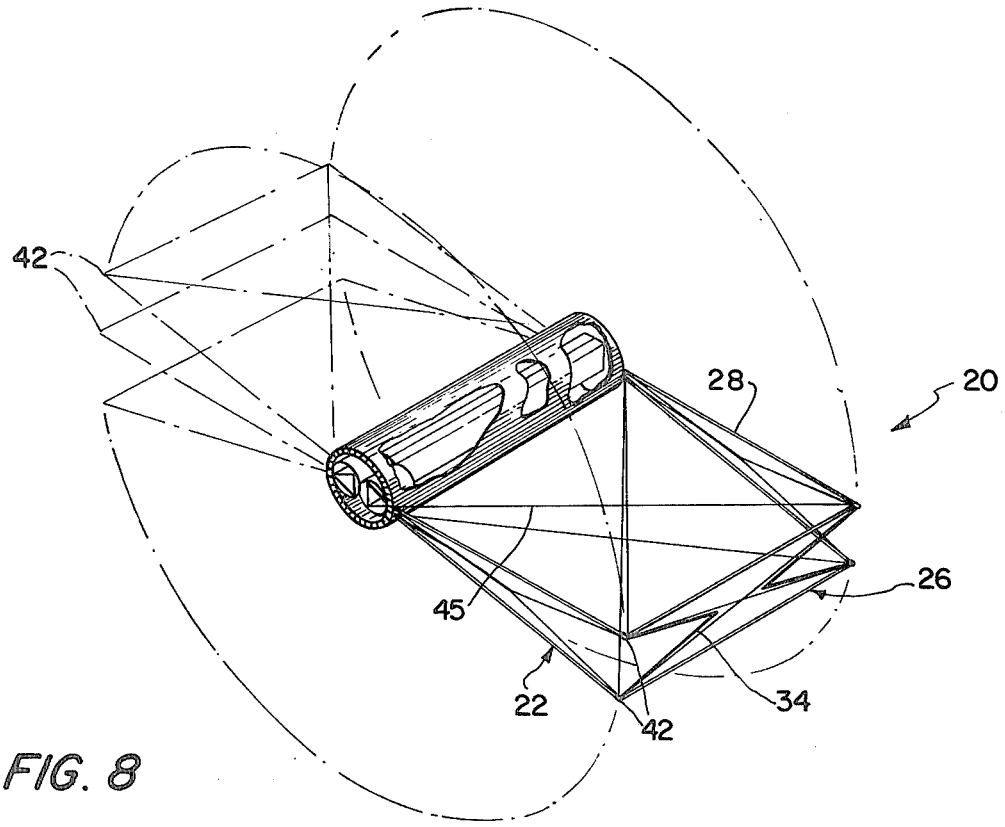

FIG. 8 shows the first stage of deployment of the box truss hoop 20. The connecting side members 28 have been deployed, allowing the outer frame 26 to emerge partially deployed. The inner frames 24 remain in the folded configuration. The diagonal braces 45 can also be seen to have extended. For clarity, only one box 22 is fully shown, the remainder being indicated by the annularly disposed corner fittings 42. The folding members 34 and 36 and the connecting side members 28 are preferably sequentially deployed as seen in FIGS. 7 through 12 through appropriate actuation means, such as, for example, the above described solenoid operated latches being selectively powered in proper sequence.

Figure 9:
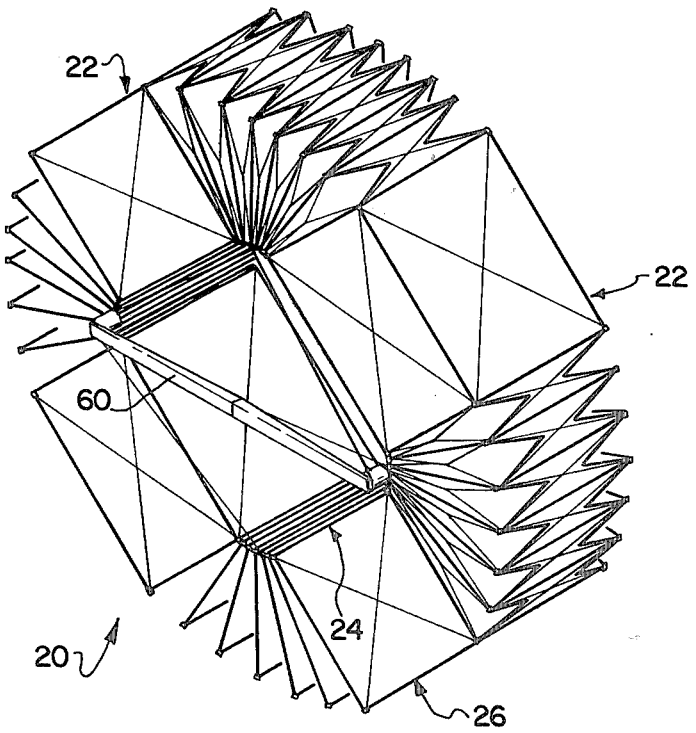

In FIG. 9, the inner frames 24 and the outer frames 26 of four of the boxes 22 have been deployed and thus the four boxes are fully deployed. The feed 60, which had been folded in half, has deployed such that it extends parallel to the plane of the box truss hoop 20.

Figure 10:
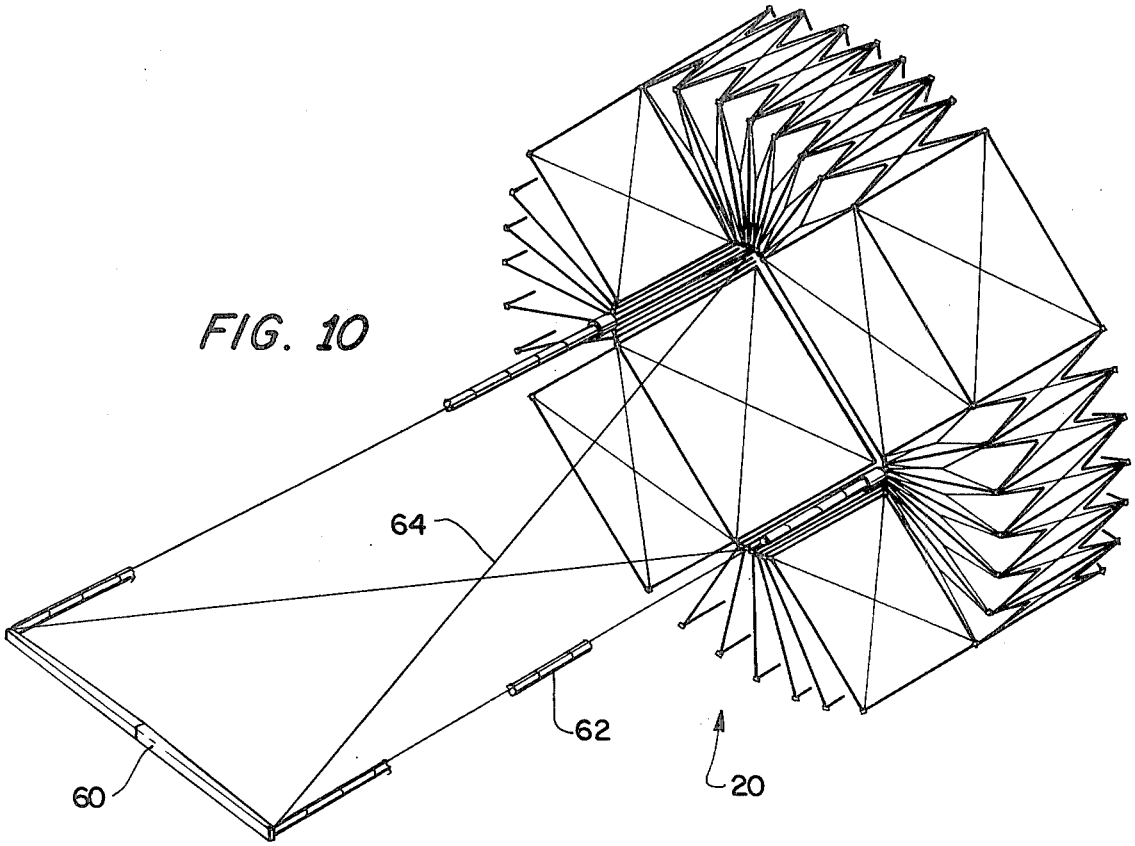

Turning to FIG. 10, feed support means have been deployed so as to position the feed 60 an appropriate distance above the box truss hoop 20. The feed support means comprises one or more masts 62 and guylines 64 which can be compactly folded and which deploy with the box truss hoop 20. Several examples of a suitable folding mast include a telescopic mast, a mast which includes sections coiled into a cannister, or a mast comprising a plurality of collapsible boxes, similar to the boxes 22.

Figure 11:
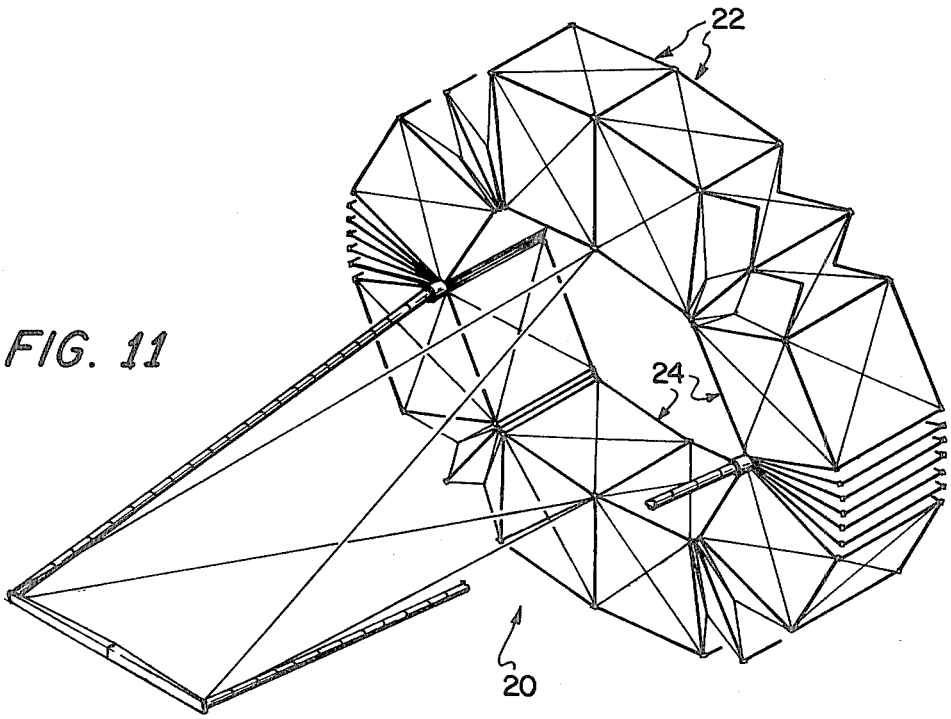

FIG. 11 shows additional boxes 22 being sequentially deployed around the circumference of the box truss hoop 20. The diameter of the hoop increases as each of the inner frames 24 deploys.

Figure 12:
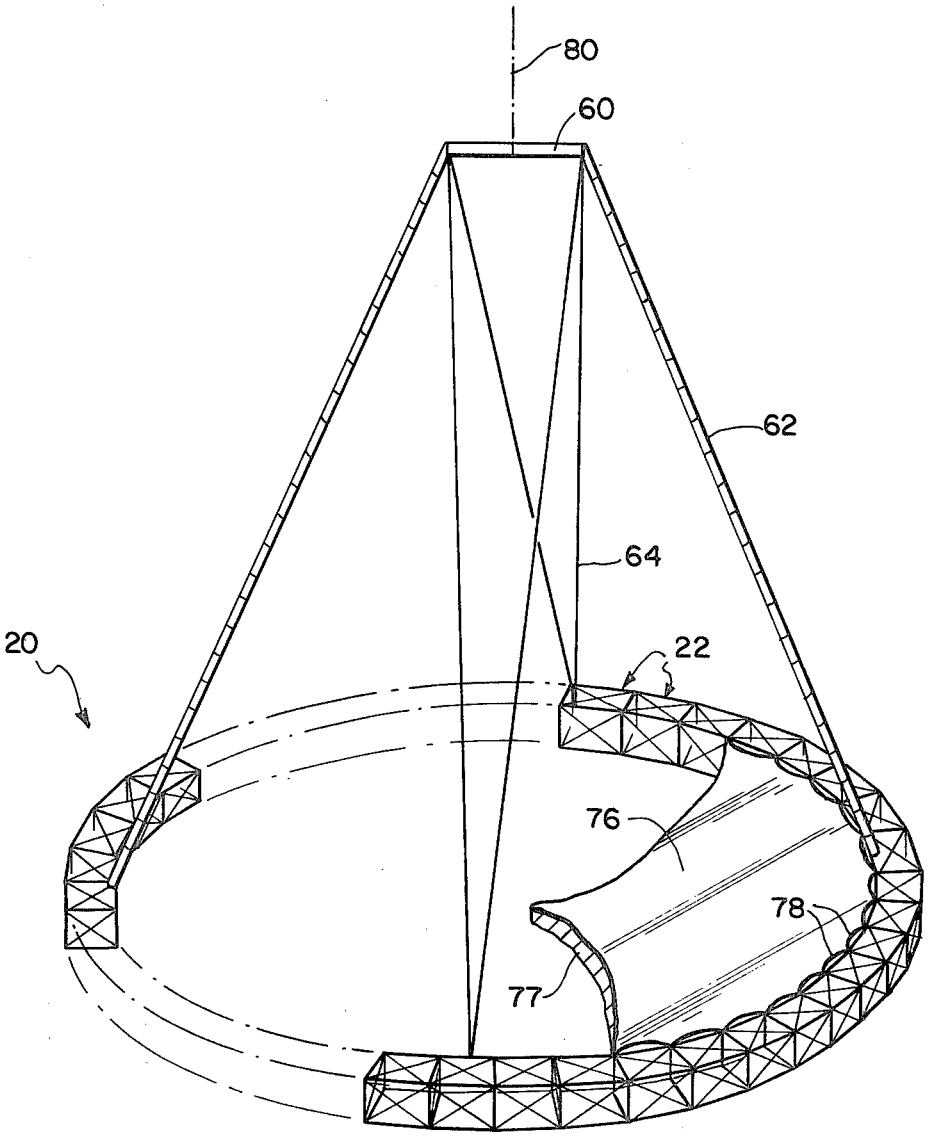

In FIG. 12, all of the boxes 22 have been deployed and thus the box truss hoop 20 is fully deployed.

Figure 13:
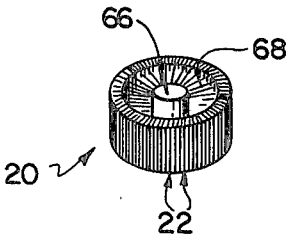
FIGS. 13 through 17 show the deployment sequence of a second embodiment of the present invention.

FIGS. 13 through 17 show the sequence of deployment of a second embodiment of the box truss hoop 20. Turning to FIG. 13, this embodiment of the box truss hoop 20 is similar to the first embodiment except that it includes a core drum 66 disposed in the center of the hoop. Tension ties 68 extend from the core drum 66 to each of the boxes 22 of the box truss hoop. The radially inner ends of the tension ties 68 are attached to means within the core drum 66 such that the tension ties can be payed out at a controlled rate to thereby control deployment of the box truss hoop. For example, the tension ties 68 could be wound around one or a series of spools (not shown) which are rotated at a selected rotational speed. FIG. 13 shows the box truss hoop 20 in a compact, folded configuration with each of the boxes 22 in a folded configuration such that together, the folded boxes define a cylinder.

Figure 14:
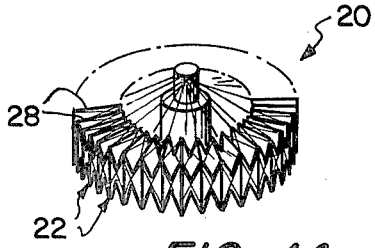

FIG. 14 shows the first stage of deployment of the box truss hoop 20. The connecting side members 28 of the boxes 22 have been deployed in any desired manner, such as through a solenoid operated latch arrangement as was described earlier. Upper and lower portions of the core drum 66 through which the tension ties run are extended axially, as is shown in FIG. 14, such that the tension ties extend to the boxes 22 at a slight angle.

Figure 15:
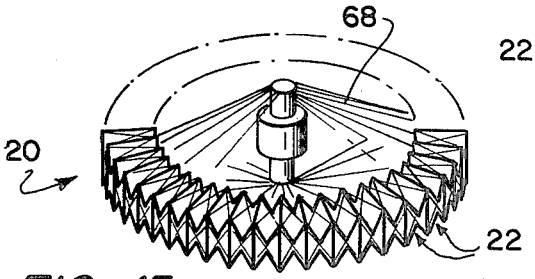
Figure 16:
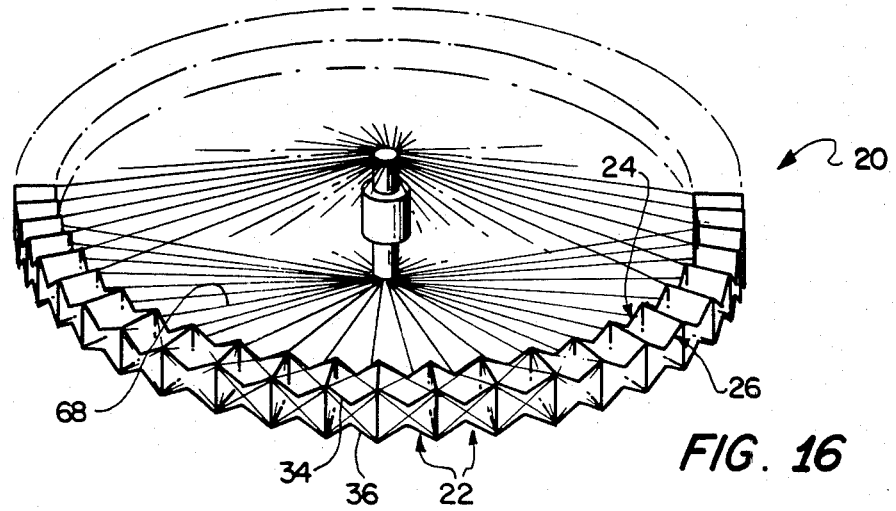

Turning now to FIGS. 15 and 16, it can be seen that as the tension ties 68 are payed out, the radius of the deploying box truss hoop 20 increases. As the radius of the hoop increases, and folding members 34 and 36, which are biased toward the deployed position, preferably with springs, also deploy. Thus, the inner frames 24 and the outer frames 26 of all of the boxes 22 deploy simultaneously.

Figure 17:
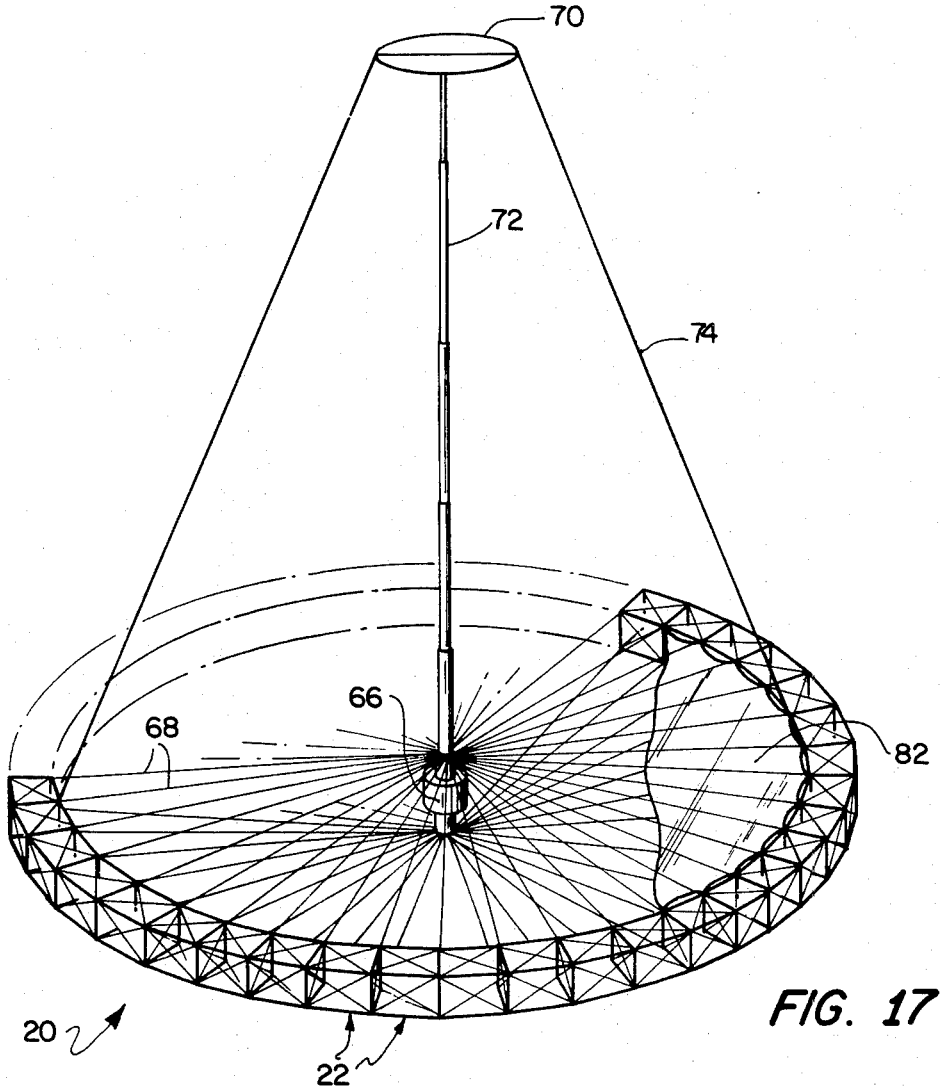

Finally, as is seen in FIG. 17, the tension ties 68 are fully payed out, all of the boxes 22 are deployed and thus the box truss hoop 20 is fully deployed. As with the first embodiment, when the box truss hoop 20 is used as an antenna, it can also include a feed 70 and feed support means, such as the mast 72. The mast 72 is foldable in some manner and deploys with the box truss hoop. For example, the mast could be telescopically configured as is shown in FIG. 17, or it could be of the type which uncoils from a cannister. For increased support, guylines 74 can extend from the mast 72 or feed 70 to the box truss hoop 20.

As is shown in FIG. 12, one important use of the box truss hoop 20 is an antenna. A reflective surface 76, only a portion of which is shown, extends across the interior of the box truss hoop 20. The reflective surface 76 must be flexible since it is stored in the interior of the box truss hoop when the hoop is in its folded configuration and deploys with the hoop during deployment. The circumferential edge of the reflective surface includes cords, or catenaries 78, which are attached to the boxes 22. Preferably, the reflective surface 76 is generally curved, preferably parabolic or spherical shaped, and the feed 60 is located at the focus of the reflective surface. With such a parabolic or spherical shape, radio waves will reflect off of the reflective surface 76 toward the feed 60 when the antenna acts as a receiver, or, when it acts as a transmitter, radio waves directed from the feed 60 will reflect from the reflective surface 76 outwardly generally parallel to or in a fan shaped pattern relative to the central axis of the antenna, depending upon the shape of the reflective surface, the central axis being depicted by the dashed line 80. The shape of the reflective surface 76 can be attained in various ways, such as through arrangements of cords (not shown) extending across the box truss hoop. As is shown in FIG. 12, another manner of controlling the shape of the reflective surface 76 is by employing a conductive, electrostatic membrane mirror as the reflective surface 76 and an electrostatic control membrane 77 below the membrane mirror, similar to the arrangement which is described in U.S. Pat. No. 4,093,351-Perkins et al, 1978, the disclosure of which is incoporated herein by reference. Briefly, an electric field created by the control membrane is used to selectively deflect the membrane mirror into the desired shape. The electrostatic membrane mirror arrangement is particularly suitable to the embodiment shown in FIG. 12 since there is no central hub to interfere with either the electrostatic membrane mirror or the control membrane.

Turning to FIG. 17, the second embodiment of the box truss hoop 20 is also shown as an antenna. This embodiment includes a reflective surface 82 which extends across the interior of the hoop. When the box truss hoop is in the folded configuration of FIG. 13, the reflective surface 82 is stored between the core drum 66 and the collapsed boxes 22. Preferably, in the deployed configuration of FIG. 17, the reflective surface 82 has a generally curved shape, preferably a parabolic or spherical shape, and the feed 70 is located at the focus of the reflective surface. Such a parabolic or spherical shape can most easily be attained by attaching appropriate sections of the reflective surface 82 to the lower sets of tension ties 68 which extends from the lower portion of the core drum 66 to the boxes 22.

As can be seen in both FIGS. 12 and 17, the first and second embodiments of the box truss hoop are of sufficient depth such that the shaped reflective surface and its shaping system can be substantially contained within the interior of the box truss hoop, rather than having to rely on additional attachment points interior to the hoop.

It is to be understood that this invention is not limited to the particular embodiments disclosed and it is intended to cover all modifications coming within the true spirit and scope of this invention as claimed. For example, although it has been described in terms of use as an antenna, the box truss hoop could also be suitably employed for many other uses where a deployable, hoop-shaped structure is desired.

What is claimed is:

1. A box truss hoop comprising a plurality of circumferentially adjacent collapsible boxes arranged whereby said box truss hoop is expandable radially from a compact, folded configuration to a deployed hoop configuration, each of said boxes comprising:

a. a collapsible inner frame and a collapsible outer frame disposed parallel and radially apart; and b. a plurality of connecting side members extending between said inner and said outer frames.

2. The box truss hoop of claim 1 wherein each said inner frame and each said outer frame comprises:

a. two rigid members;

b. two folding members, one of said folding members extending between each pair of corresponding ends of said rigid member; and c. axially expandable diagonal braces extending between each pair of diagonally opposite ends of said rigid members.

3. The box truss hoop of claim 2 wherein in at least some of said boxes, said folding members of said inner frame are shorter than said folding members of said outer frame for thereby providing a curved shape to said box truss hoop.

4. The box truss hoop of claim 3 wherein each of said boxes includes four connecting side members, each of said connecting side members extending generally radially between a pair of corresponding corners of said inner and said outer frames.

5. The box truss hoop of claim 4 wherein said connecting side members are foldable.

6. The box truss hoop of claim 5 further comprising axially expandable diagonal braces extending between each pair of opposite corners of said inner and said outer frames in the surface planes of each of said boxes.

7. The box truss hoop of claim 6 wherein some of said diagonal braces are telescopically configured and the remainder of said diagonal braces are coilable for thereby being axially expandable.

8. The box truss hoop of claim 6 arranged wherein for each pair of adjacent boxes, a rigid member of said inner frame, a rigid member of said outer frame, two connecting side members, and diagonal braces lying in the plane of said two connecting side members are common to and thereby comprise portions of both of said adjacent boxes.

9. The box truss hoop of claim 7 further comprising biasing means for urging said folding members and said connecting side members toward a deployed position.

10. The box truss hoop of claim 9 wherein each of said folding members and each of said connecting side members is hinged for folding at the center thereof and wherein said biasing means comprises a spring disposed adjacent the hinged center of each of said folding members and each of said connecting side members.

11. The box truss hoop of claim 10 further comprising actuation means for effecting deployment of said box truss hoop.

12. The box truss hoop of claim 11 wherein said actuation means comprises a plurality of solenoid operated latch arrangements for, when said box truss hoop is in a folded configuration, maintaining at least some of said folding members and some of said connecting side members in folded positions and for, when deployment of said box truss hoop is desired, releasing and thereby deploying at least some of said folding members and some of said connecting side members.

13. The box truss hoop of claim 12 further comprising central control means for selectively supplying electrical power to said solenoid operated latch arrangements in a sequential manner for thereby deploying said folding members and said connecting side members in a preselected sequence.

14. The box truss hoop of claim 13 wherein each of said solenoid operated latch arrangements comprises a resilient latch and a solenoid having a movable plunger extending therefrom, said latch being mounted with a first rigid member and including a flange sized for being received in a depression adjacent a second rigid member, said plunger being positioned by said solenoid for abutting said latch and thereby maintaining said flange in said depression when said box truss hoop is in a folded configuration and being retracted by said solenoid from said latch and thereby permitting said flange to be resiliently released from said depression for deploying said box truss hoop.

15. The box truss hoop of claim 11 wherein said actuation means comprises a core drum disposed in the center of said box truss hoop and a plurality of tension ties extending from said core drum to each of said boxes, radially inner ends of said tension ties being attached to means within said core drum whereby said tension ties can be payed out at a controlled rate for controlling deployment of said boxes and thereby of said box truss hoop.

16. The box truss hoop of claim 15 further comprising a reflective surface extending across said box truss hoop and foldable therewith.

17. The box truss hoop of claim 16 wherein said reflective surface is generally curved.

18. The box truss hoop of claim 17 wherein selected portions of said reflective surface are attached to said tension ties for thereby maintaining the curved shape of said reflective surface.

19. The box truss hoop of claim 13 further comprising a reflective surface extending across said box truss hoop and foldable therewith.

20. The box truss hoop of claim 19 wherein said reflective surface is generally curved.

21. The box truss hoop of claim 20 wherein said reflective surface is conductive and further comprising means for creating an electric field adjacent said reflective surface for selectively deflecting and thereby maintaining the curved shape of said reflective surface.

22. The box truss hoop of claim 18 or 21 further comprising a feed disposed at approximately the focus of said reflective surface and feed support means.

23. The box truss hoop of claim 22 wherein said feed support means comprises at least one foldable mast extending from a portion of said box truss hoop to said feed.

24. A box truss hoop comprising:

a. a plurality of circumferentially adjacent collapsible boxes arranged whereby said box truss hoop is expandable radially from a compact, folded configuration to a deployed hoop configuration, each of said boxes comprising:

(1) a collapsible inner frame and a collapsible outer frame disposed parallel and radially apart, each of said inner and outer frames comprising:

i. two rigid members;

ii. two folding members, one of said folding members extending between each pair of corresponding ends of said rigid members and including biasing means for urging said folding members to a deployed position; and iii. axially expandable diagonal braces extending between each pair of diagonally opposite ends of said rigid members;

(2) four foldable connecting side members, each of said connecting side members extending generally radially between a pair of corresponding corners of said inner and said outer frames and including biasing means for urging said connecting side members to a deployed position; and (3) axially expandable diagonal braces extending between each pair of diagonally opposite corners of said inner and said outer frames in the surface planes of each of said boxes;

b. a generally curved reflective surface extending across said box truss hoop and foldable therewith;

c. a feed disposed at approximately the focus of said reflective surface; and d. feed support means extending from a portion of said box truss hoop to said feed.

25. The box truss hoop of claim 24 wherein said reflective surface is generally parabolic shaped.

26. The box truss hoop of claim 24 wherein said reflective surface is generally spherical shaped.

* * * * *